US005147467A

United States Patent [19]

Virtue

[11] Patent Number: 5,147,467

[45] Date of Patent: Sep. 15, 1992

[54] METHOD FOR CLEANING A TEXTILE FLOOR COVERING

[76] Inventor: Cheryl Virtue, 3598 Kings Way, #36, Sacramento, Calif. 95821

[21] Appl. No.: 687,961

[22] Filed: Apr. 19, 1991

[51] Int. Cl.[5] ..... B08B 1/00; B08B 3/02; B08B 5/04; B08B 7/04

[52] U.S. Cl. ..... 134/18; 134/21; 15/98; 15/320; 15/321

[58] Field of Search ..... 16/98, 320, 321; 134/18, 21

[56] References Cited

U.S. PATENT DOCUMENTS

| | | | |
|---|---|---|---|
| 3,625,890 | 12/1971 | Sramek . | |
| 3,964,925 | 6/1976 | Burgoon | 134/21 |
| 4,063,961 | 12/1977 | Howard et al. | 134/21 |
| 4,081,383 | 3/1978 | Warburton, Jr. et al. . | |
| 4,123,818 | 11/1978 | Hurwitz | 15/321 |
| 4,160,777 | 7/1979 | Loudas . | |
| 4,168,563 | 9/1979 | O'Bryan . | |
| 4,351,081 | 9/1982 | Tarkinson | 15/98 |
| 4,652,389 | 3/1987 | Moll . | |
| 4,780,100 | 11/1988 | Moll . | |

FOREIGN PATENT DOCUMENTS 890567 3/1962 United Kingdom .

*Primary Examiner*—Theodore Morris
*Assistant Examiner*—Zeinab El-Arini
*Attorney, Agent, or Firm*—James M. Ritchey

[57] ABSTRACT

Disclosed is an apparatus and method of use for cleaning a textile floor covering. The subject apparatus comprises a cleaning composition reservoir, a container holding a pressurized gas, an adjustable valve for regulating the pressure of the released gas, a gas delivery conduit connecting the gas container to the reservoir, an application wand having an atomizing nozzle that generates a mist of cleaning composition, and a cleaning composition conduit connecting the wand and the reservoir. The method comprises misting the cleaning composition onto the floor covering, agitating the wetted fibers, and buffing the floor covering to assist in drying.

7 Claims, 4 Drawing Sheets

METHOD FOR CLEANING A TEXTILE FLOOR COVERING

BACKGROUND OF THE INVENTION

1. Field of the Invention

Disclosed is an apparatus and method of use for cleaning the nap of a textile floor covering. Specifically, the apparatus employs a water solution of non-ionic cleaning composition that is atomized under high pressure and applied to the nap. The applied atomized cleaning solution wets the textile's nap surface, yet limits the amount of wetting to the textile's backing material. After application of the cleaning composition, mechanical agitation of the wetted textile nap aids in freeing filth deposits lodged in the nap. Principal drying of the nap is by mechanical cloth buffing.

2. Description of the Background Art

Various basic methods for cleaning carpets exist in the prior art, as do machines to implement such cleaning procedures. In general, these approaches often produce a carpet that is heavily wetted and then, hopefully, immediately dried by vacuum removal of the wetting substance. In practice, a significant portion of the wetting solution usually remains in the backing of the carpet and often in the fibers of the carpet. Before using the carpet the remaining liquid needed to be air dried, usually for overnight or longer. The subject device wets only the fibers and not significantly the backing material. Therefore, the subject cleaning technique is rapid and does not result in the slow decomposition of a wetted backing.

Set forth in British Patent No. 890,567 is an improved cleaning liquid. An aliphatic hydrocarbon is emulsified with water in the presence of a nonionic surface active agent.

Processes and compositions for the treatment of textile materials are presented in U.S. Pat. No. 3,625,890. The processes and compositions are designed to eliminate the presence of static electricity on carpeting and other textiles.

Delineated in U.S. Pat. No. 4,081,383 is an anti-soiling treatment for carpets and carpet yarns. Copolymers are employed to treat carpets or carpet yarns prior to carpet production. The selected copolymers aid in preventing soiling of the carpet.

U.S. Pat. No. 4,160,777 introduces a fluorochemical compound useful for treating textiles to prevent soiling by oils and water. Detergent-compatable fluorochemical compounds are dispersed in a suitable liquid and applied to the textile.

A system for carrying out the in situ cleaning of a carpet is related in U.S. Pat. No. 4,168,563. A pump is provided to generate pressure that delivers a jet spray of cleaning solution onto a textile floor covering. A pressure of at least 100 psi is required to deliver the spray. The quantity of cleaning solution delivered is sufficient in volume to soak the textile fibers, and if not immediately removed, to wet the backing of the textile. To remove the cleaning solution a vacuum and waste system are included. Immediately after the application of the cleaning solution the suction device is employed to remove the bulk of the liquid. Evaporation is used to complete the drying process.

A carpet cleaning composition is furnished in U.S. Pat. Nos. 4,652,389 and 4,780,100. A gas pressurized can contains a cleaning solution that foams upon delivery to a carpet. After foaming, the composition collapses into the carpet fibers. Finally, the composition refoams around the carpet's fibers, therefore aiding in loosening any soil from the fibers.

Disclosed in U.S. Pat. No. 4,219,333 is a carbonated cleaning solution. An aqueous cleaning composition is described that has between 0.1 and 5.0 percent by weight of one or more nonionic or anionic surfactants. The solution is maintained at a pressure of from 1 to 10 atmospheres.

SUMMARY OF THE INVENTION

An object of the present invention is to provide an apparatus that delivers a mist of cleaning composition to wet the fibers of a carpet without significantly wetting the supporting backing material of the carpet.

A further object of the present invention is to produce a carpet cleaning apparatus that is easy both to move during use and to operate is delivering a mist of cleaning composition onto the fibers of a carpet.

An additional object of the present invention is to generate a method for cleaning a textile fabric, specifically a rug or carpet, that does not result in over application of the cleaning liquid, thereby allowing essentially complete drying is a short period of time and preventing possible damage to the backing material of the carpet when insufficient drying follows the liquid's application.

Disclosed is an apparatus and method of using the apparatus for cleaning a textile floor covering such as a carpet or rug. Comprising the subject apparatus is a cleaning composition reservoir, a container holding a pressurized gas, an adjustable valve for regulating the pressure of the released gas, a gas delivery conduit connecting the gas container to the reservoir, an cleaning composition application wand that has an atomizing nozzle that creates a fine mist of cleaning composition, and a cleaning composition conduit connecting the wand and the reservoir. Since existing methods of cleaning a carpet often result in excessive wetting of the fibers and the supporting backing material, with an accompanying chance of damage to the carpet's backing, the subject method comprises a system that does not significantly wet the backing, yet dampens the fibers sufficiently for cleaning. The subject method involves misting the cleaning composition onto the floor covering, agitating the wetted fibers with a buffer, and buffing dry the floor covering.

Other objects, advantages, and novel features of the present invention will become apparent from the detailed description that follows, when considered in conjunction with the associated drawings.

DESCRIPTION OF THE PREFERRED EMBODIMENT

Referring now to FIGS. 1–4, there is shown a preferred embodiment of a textile floor covering cleaning apparatus that is employed by a user to remove dirt, stains, and the like from carpets, rugs, and similar items, including upholstery and fabrics. Textile floor coverings usually comprise an upper surface of fibers that are anchored into and extend from a supporting backing material. Should the floor covering backing material become unduly wet during cleaning, many hours are generally required to thoroughly dry the backing. Without a thorough drying, the backing tends to degrade with time. Backing that is wet for a prolonged period of time or is overly wet tends to have seam separations, separation of fibers from the backing, bacterial growth, color streaking, and "brown out" due to oxidation and other chemical reactions caused by remaining high alkaline or acidic residues. Prior cleaning procedures often wetted the backing to a degree that did not permit sufficient drying before limited or extensive degradation occurred. This device (and method) is for cleaning the surface fibers of the textile floor covering with a cleaning composition that wets the fibers without substantially or significantly wetting the supporting backing material.

Figure 1:
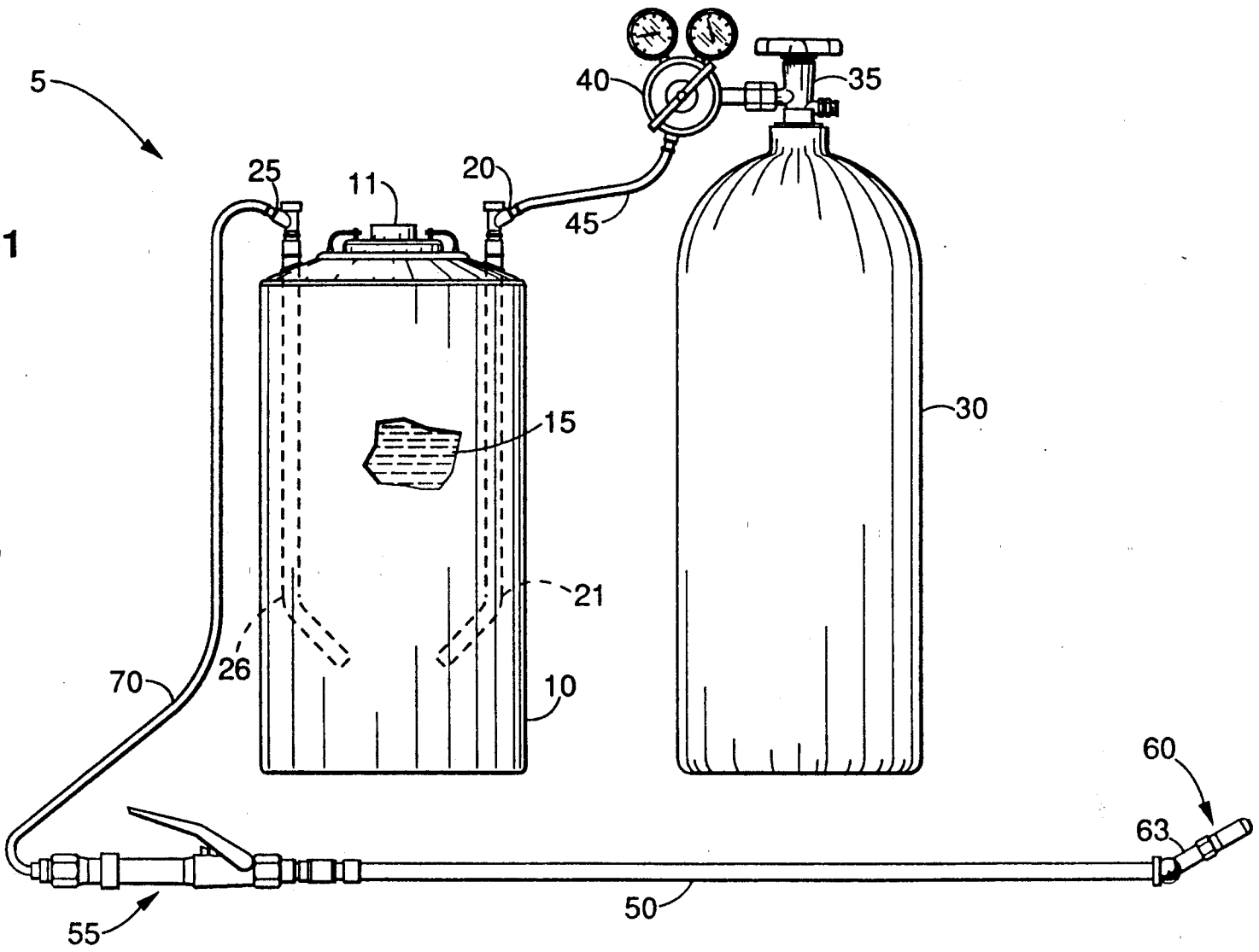
FIG. 1 is a front view of the elements of the subject apparatus.

The subject apparatus 5, as illustrated in particular in FIG. 1, comprises a reservoir 10 for holding a liquid suspension or mixture of cleaning composition 15. The reservoir 10 is fabricated from suitable material such as, but not limited to, stainless steel and polymers. The fabrication material and structural design of the reservoir 10 must be able to withstand internal pressures of not greater than about 200 psi (pounds per square inch). Generally, the reservoir 10 is a cylinder having a bottom and a top and a hatch or mouth 11 for filling the reservoir 10 with a liquid cleaner (usually water and a selected cleaner, see below). Within the upper portion of the reservoir 10 is a gas entry port 20 having a gas delivery tube 21, with proximal and distal ends, secured by the proximal end to the entry port 20. Any traditional port system for the gas entry port 20 that provides an entry into the reservoir 10 is envisioned as suitable for the subject apparatus 5, including a valved or non-valved faucet, spigot, spout, tap, or the like. The gas delivery tube 21 is essentially a rigid tube having an opening at the distal end. The distal end extends proximate the inside bottom of the reservoir 10. When the reservoir is filled with cleaning composition 15, the gas delivery tube 21 is significantly below the surface of the cleaning composition 15.

Further, the reservoir 10 has a cleaning composition exit port 25 having an associated cleaning composition exiting tube 26, with proximal and distal ends, secured by the proximal end to the exit port 25. As above with the gas entry port 20, the exit port 25 is a standard valved or non-valved faucet, spigot, spout, tap, or the like that spans from the exterior of the reservoir 10 to the interior of the reservoir 10. When the cleaning composition 15 is delivered onto the floor covering the composition 15 leaves the reservoir 10 through this tube 26, via the distal end which is proximate the bottom of the reservoir 10. Other equivalent configuration for the reservoir 10 and associated ports (20 and 25) and tubes (21 and 26) are considered to be within the realm of this disclosure.

The cleaning composition 15 is comprised of a water containing emulsion of a mixture of hydrophobic and hydrophilic cleaning substances. Examples of such substances are found in standard technology texts such as Kirk-Othmer, *Encyclopedia of Chemical Technology*, Third Ed., Vol. 22, pp. 347–387 and *McCutcheon's Detergents and Emulsifiers*, North American Ed., 1983, which are incorporated herein by reference. The mixture of hydrophobic and hydrophilic cleaning substances may be nonionic. Specifically, an example of a preferred cleaning composition 15 is a phosphate free cleaning product termed GEM SHEEN TM (produced by Ultra Labs, Hayward, Calif.).

To deliver the liquid cleaning composition 15 onto the fibers of the floor covering, a pressurized gas, preferably nitrogen or the like, is employed. To allow for mobility of the subject apparatus a cylinder is usually employed as a gas container 30. The gas cylinder 30 has a gas port 35, ordinarily on the upper portion of the cylinder 30. Standard commercial nitrogen gas cylinders are suitable for the subject device's gas container 30. The gas port 35 is usually equiped with a valve for releasing the gas.

Secured, generally by threaded means, to the gas port 35 is means for regulating the flow of gas from the gas port 35. Preferably, the gas regulating means is a gas pressure regulator 40. Typically, the regulator 40 has a first gauge to record the pressure of the gas remaining within the cylinder 30 and a second gauge that gives the pressure of the delivered gas. For the subject device the pressure of the delivered gas is generally between about 80 psi and about 140 psi and preferably between about 90 psi and about 100 psi. A gas delivery conduit 45 connects the pressure regulating flow means 40 with the reservoir gas entry port 20. Standard means are used to secure the conduit 45 to the valve 40 and port 20. The conduit 45 is usually a flexible hose compatible with the pressurized gas.

For controlling the release of the cleaning composition onto the selected floor covering and the generation of a actual mist of the cleaning composition, a wand is included in the subject apparatus. The wand has first and second ends and generally an elongated hollow central body 50 that is usually a rigid or semi-rigid tube fabricated from metals or polymers that are resistant to damage by the cleaning composition. Further comprising the wand, generally located at the first end of the wand, is a means for activating the delivery of the cleaning composition onto the carpet. This activating means is usually a hand activated valve or an equivalent device with a lever, knob, or handle or the like that is easily opened and closed to regulate the flow of the cleaning composition into the wand.

Figure 2:
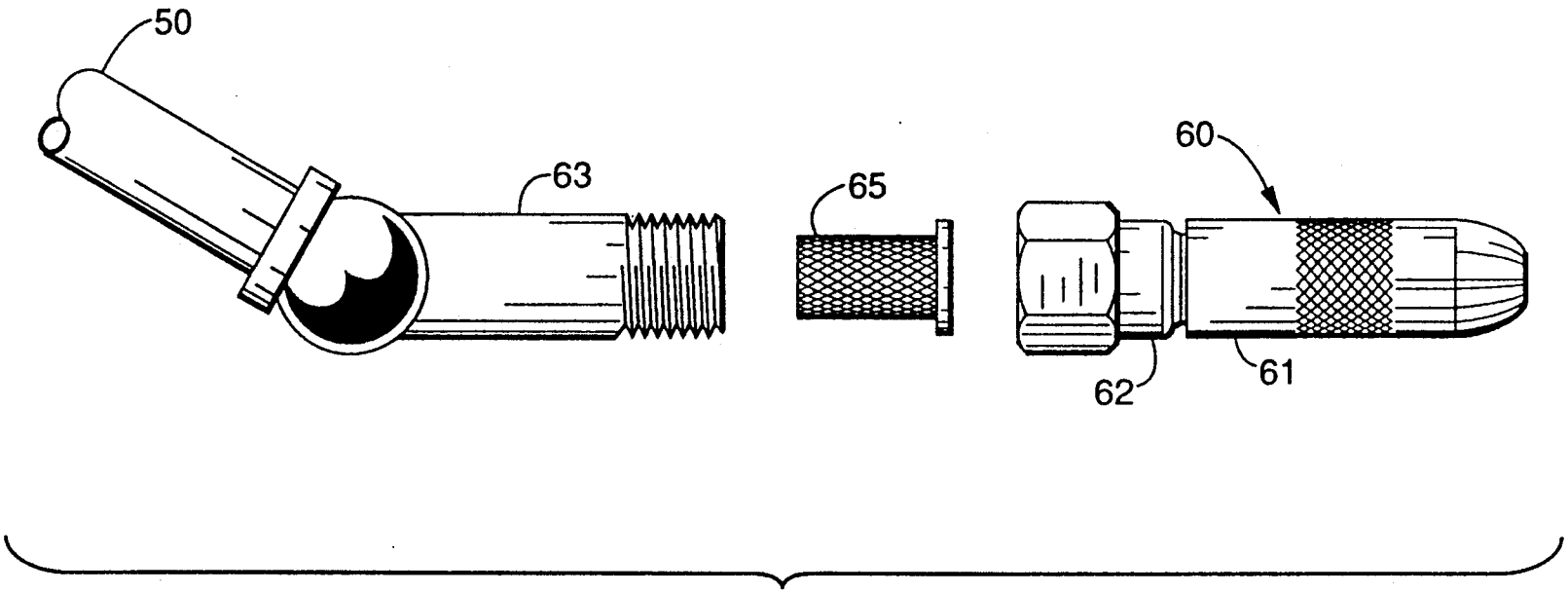
FIG. 2 is a front view of the atomizing nozzle, mesh filter, and terminal portion of the application wand.

At the second end of the wand is a means for producing or generating a mist of the cleaning composition. The mist generating means is ordinarily an adjustable atomizing nozzle 60 that vaporizes the cleaning composition into a finely divided mist. The atomizing nozzle 60 releases between about 0.05 and about 0.3 gallons of cleaning composition per minute when the pressure is between about 30 psi and 140 psi, normally between about 0.1 and about 0.3 gallons per minute for a pressure range of between about 80 psi and about 140 psi, more usually between about 0.1 and about 0.3 gallons per minute for a pressure range between about 85 psi and about 110 psi, and preferably about 0.1 to about 0.3 gallons per minute when the pressure is regulated to between about 90 psi and about 100 psi. Specifically, an example of such an atomizing nozzle is one produced by Spraying Systems Company of Wheaton, Ill. (supplied by Sande Equipment Company, Monterey Park, Calif.; part number 5500 X8; which is rated to deliver about 0.21 gallons of mist per minute and gives a particle size of about 150 microns at 40 psi). Although equivalent adjustable or non-adjustable nozzles will function to delivery a mist for the subject invention, as seen in FIG. 2, the Spraying Systems Company's nozzle comprises an outer threaded female barrel 61 and an inner threaded male spigot 62. To adjust the particle size of the mist the barrel 61 is rotated, relative to the inner threaded male spigot 62, in (towards the central body 50 for a finer mist) or out (away from the central body 50 for a courser mist).

The atomizing nozzle 60 is usually connected to the central body 50 via a movable coupler 63. Although this coupler 63 need not be present, it is handy to be able to position the mist at a desired angle. Included in the subject invention is a filtering screen 65 (usually about 100 mesh). The screen 65 removes any components within the cleaning composition that might plug the atomizing nozzle 60. Although the filtering screen illustrated in FIG. 2 fits within the coupler 63, other equivalent configuration are considered to be within the realm of this disclosure.

Connected, by standard means, between the cleaning composition exiting port 25 and the first end of wand (via the mist activating means 55), is a cleaning composition delivery conduit 70. This conduit 70 is normally a flexible hose compatible with and not damaged by the cleaning composition 15. The length of the conduit 70 is sufficient to permit an operator unrestricted movement during the misting of the carpet.

To use the subject apparatus 5 in the cleaning of a selected textile floor covering C (see FIGS. 3 and 4) a mobile carrier 75 is usually provided. The carrier is normally a standard wheeled hand cart or dolly to which is attached (by straps or equivalent means) the reservoir 10 and gas container 30.

Figure 3:
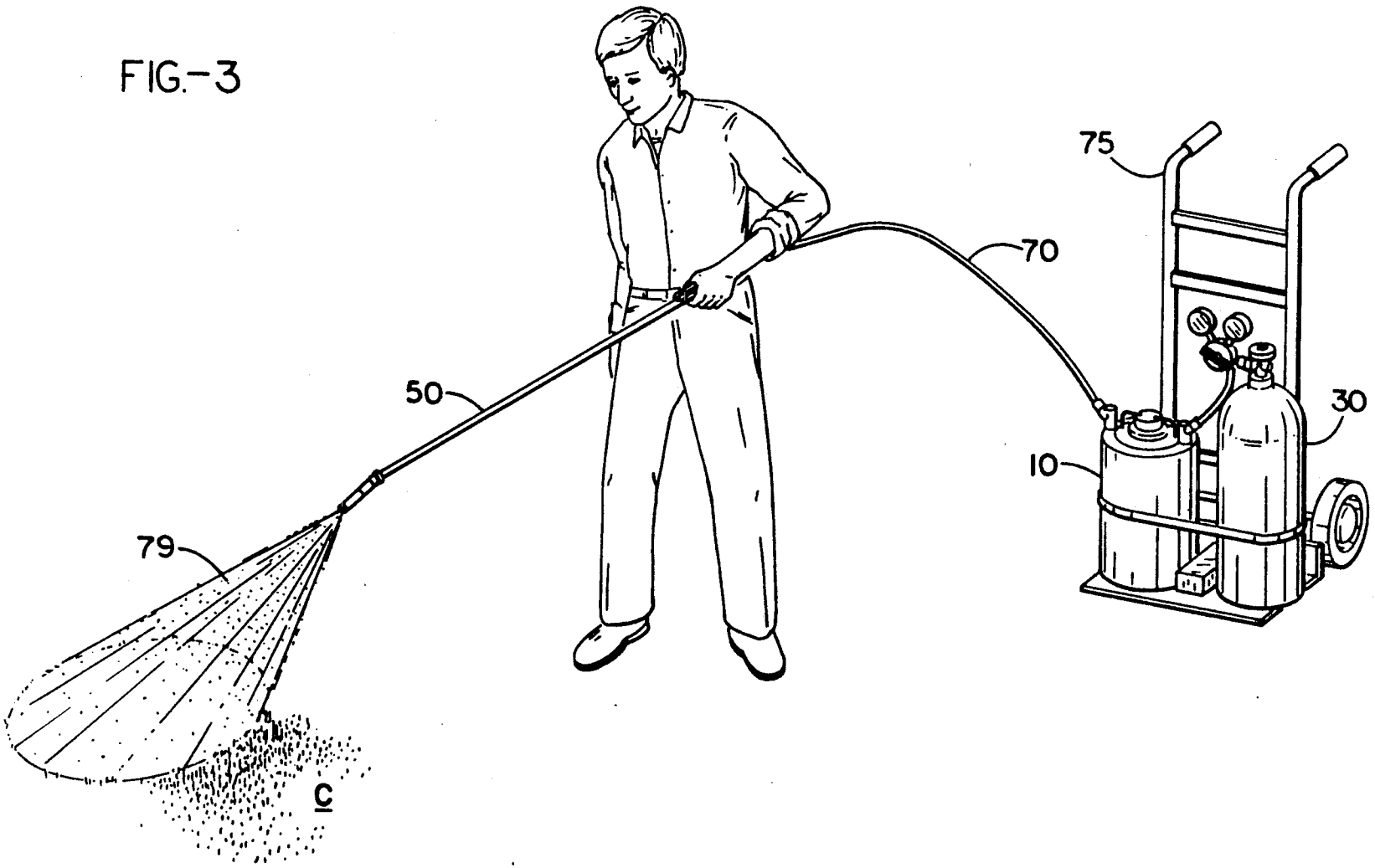
FIG. 3 is a perspective view of a user employing the subject device to apply cleaning composition to a textile floor covering.
Figure 4:
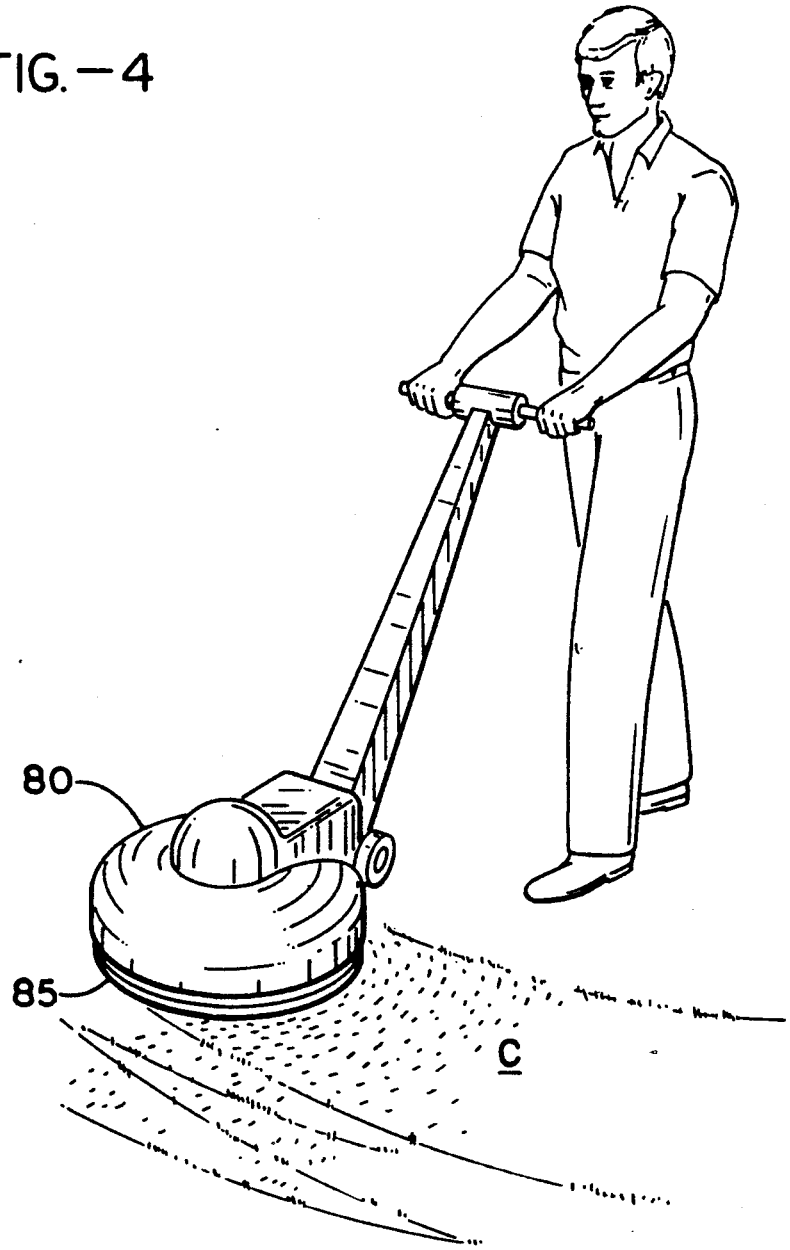
FIG. 4 is a perspective view of a user of the subject method rotary buffing a wetted textile floor covering either to agitate the surface fibers or to dry the surface fibers.

As depicted in FIGS. 3 and 4, a user employs the subject apparatus by first mixing the selected cleaning composition with water (or using a premixed composition) and filling the reservoir 10 with a desired amount of the cleaning composition 15. The reservoir is sealed and the gas within the gas container 30 released into the reservoir 10 and regulated to a selected pressure.

When the user or operator is positioned proximate the carpet area to be cleaned, the user activates the mist delivering valve 55 and a fine mist 79 exists the atomizing nozzle 60. Preferably, the nozzle 60 is positioned about one to two feet above the carpet's fibers. The produced mist 79 is applied in a generally uniform layer over the fibers to thoroughly dampen, but not overly wet the carpet. This mist 79 dampening wets essentially only the fibers and not substantially the supporting backing material. Substantially not wetted is defined to mean that the backing material is essentially dry after the fibers are dried.

The wetted fibers are then agitated to further aid in cleaning by emulsifying the cleaning composition into the soiling materials on the fibers. Since the fibers are mist dampened only, the agitation does not result in significant additional wetting of the underlying backing material. Preferably, a standard upright rotary buffer 80, normally a standard slow speed buffer, having a motor driven rotating drum with a buffing surface 85 is employed. Attached to the buffing surface 85, serving as an agitating means, is an essentially nonabsorbent pad such as an acrylic pad or similar pad. The non-damaging pad replaces traditional brushes that may damage the fibers.

Before the cleaning composition significantly wet the backing material, the fibers are dried. To dry the fibers an absorbant pad is attached to the buffer's buffing surface. Preferably, a series of two dryings are conducted. A first absorbant pad is employed to pick up most of the cleaning composition and soiling materials. This first absorbant pad is usually a heavy cotton shag pad. To finish the drying process a second absorbant pad is then used on the buffer. This second absorbant pad is generally a heavy terry cloth material. Other equivalent absorbant materials may be substituted for either or both the first and second absorbant pads.

As an optional final step in cleaning the floor covering the carpet is raked. The raking lifts the fibers and gives the carpet a new appearance. The carpet is now virtually residue free and dry in about one to two hours.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A method of cleaning a textile floor covering having surface fibers and an underlying and supporting backing material, comprising the steps of:

a) finely misting said fibers of said textile floor covering with an atomized liquid cleaning compound whereby said cleaning compound wets said surface fibers only and not substantially said backing material;

b) agitating said wetted fibers to further emulsify said cleaning compound and to aid in cleaning said fibers; and c) drying said agitated and wetted fibers before said cleaning compound significantly wets said backing material d) raking said fibers after said drying step.

2. A cleaning method according to claim 1, wherein said agitating and said drying is by means of a rotary buffer having a buffing surface employing an essentially nonabsorbent pad on said buffing surface for said agitating and a first absorbant pad on said buffing surface for drying.

3. A cleaning method according to claim 2, further comprising the step of a second drying by means of said rotary buffer employing a second cleaning compound absorbant pad on said buffing surface after using said first absorbant pad.

4. A method of cleaning a textile floor covering according to claim 1, wherein said atomized liquid cleaning compound is delivered at the rate of between about 0.05 and about 0.3 gallons per minute under a regulated delivery pressure of between about 30 psi and about 140 psi.

5. A method of cleaning a textile floor covering according to claim 1, wherein said atomized liquid cleaning compound is delivered at the rate of between about 0.1 and about 0.3 gallons per minute under a regulated delivery pressure of between about 80 psi and about 140 psi.

6. A method of cleaning a textile floor covering according to claim 1, wherein said atomized liquid cleaning compound is delivered at the rate of between about 0.1 and about 0.3 gallons per minute under a regulated delivery pressure of between about 85 psi and about 110 psi.

7. A method of cleaning a textile floor covering according to claim 1, wherein said atomized liquid cleaning compound is delivered at the rate of between about 0.1 and about 0.3 gallons per minute under a regulated delivery pressure of between about 90 psi and about 100 psi.

* * * * *